US008792811B2

(12) United States Patent
Shirakata

(10) Patent No.: US 8,792,811 B2
(45) Date of Patent: Jul. 29, 2014

(54) BELT DRIVING APPARATUS AND IMAGE FORMING APPARATUS INCLUDING THE BELT DRIVING APPARATUS

(75) Inventor: Jiro Shirakata, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 82 days.

(21) Appl. No.: 13/616,500

(22) Filed: Sep. 14, 2012

(65) Prior Publication Data

US 2013/0078011 A1 Mar. 28, 2013

(30) Foreign Application Priority Data

Sep. 28, 2011 (JP) ..... 2011-212530

(51) Int. Cl.
*G03G 15/01* (2006.01)
*G03G 15/00* (2006.01)

(52) U.S. Cl.
CPC .... *G03G 15/754* (2013.01); *G03G 2215/00143* (2013.01); *G03G 2215/00156* (2013.01)
USPC ..... 399/302

(58) Field of Classification Search
CPC ..... G03G 2215/00143; G03G 2215/00156; G03G 2215/0016; G03G 2215/00164
USPC ..... 399/302
See application file for complete search history.

(56) References Cited

U.S. PATENT DOCUMENTS

| | | | | |
|---|---|---|---|---|
| 6,628,909 | B2 * | 9/2003 | Monahan et al. | 399/116 |
| 8,045,904 | B2 | 10/2011 | Shirakata | |
| 2008/0056778 | A1 * | 3/2008 | Tao et al. | 399/302 |
| 2011/0097095 | A1 | 4/2011 | Shirakata | |

FOREIGN PATENT DOCUMENTS

JP 2002-2999 A 1/2002

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

A belt driving apparatus includes: an endless belt member; a belt driving portion for driving the belt member to move the belt member in an endless path at a variable traveling speed; a steering roller, provided tiltably while stretching the belt member, for steering the belt member during traveling; a steering driving portion for tilting the steering roller at a variable tilting speed; and a controller for setting the tilting speed, when the steering roller is tilted through a certain angle, so as to be higher when the traveling speed of the belt member is a first traveling speed than when the traveling speed of the belt member is a second traveling speed lower than the first traveling speed.

15 Claims, 12 Drawing Sheets

(a)

(b)

(a)

(b)

BELT DRIVING APPARATUS AND IMAGE FORMING APPARATUS INCLUDING THE BELT DRIVING APPARATUS

FIELD OF THE INVENTION AND RELATED ART

The present invention relates to a belt driving apparatus for effecting lateral deviation (lateral shift) control of a belt member and an image forming apparatus including the belt driving apparatus.

The image forming apparatus for forming an image by using the belt member has been widely used. For example, an image forming apparatus of an electrophotographic type in which toner images formed on an image bearing member are collectively transferred onto a recording material via an intermediary transfer belt has been used widely. Also an image forming apparatus of an electrophotographic type in which the toner image formed on the image bearing member is transferred onto the recording material attracted to a recording material conveyance belt have been used widely. In the image forming apparatus, in order to melt the toner image to be fixed on the recording material, a fixing device in which a heating nip is formed by using a belt member is mounted in some cases. Further, the image forming apparatus includes an ink jet printer or the like in which an image is printed from a fixed print head onto the recording material placed and conveyed on the recording material conveyance belt.

These belt members causes, when lateral movement (lateral deviation) in a direction perpendicular to a rotational direction is generated during image formation, oblique distortion of an output image and positional deviation, so that an image quality is adversely affected. For this reason, in the image forming apparatus in which the belt member is mounted, lateral deviation control in which an amount (distance) of lateral movement of the belt member is detected in real time and one or more steering roller for stretching the belt member is tilted in real time to quickly suppress the lateral movement is executed (Japanese Laid-Open Patent Application (JP-A) 2002-2999).

However, when the steering roller is tilted in a state in which the belt member is rotated, similarly as in the case where a steering operation is performed in an automobile which travels a road surface, a steering resisting force is exerted from the belt member on the steering roller. The steering resisting force causes bending of a steering roller supporting structure and vibration of the steering roller to unstabilize traveling of the belt member and steering control, so that there is a possibility that the steering resisting force has the influence on a quality of an output image.

Therefore, in JP-A 2002-2999, a tilting direction and tilting locus of the steering roller are set so that the steering resisting force becomes minimum.

In recent years, with respect to the belt member for the image forming apparatus, a plurality of levels of rotational speeds have been set.

For example, in the case where the toner image is transferred onto thick paper and then is fixed by the fixing device, in order to ensure a required fixing temperature for the thick paper having a large thermal capacity, an image forming process speed is lowered, so that the rotational speed of the belt member is switched to a low level.

In this case, similarly as in the case where the steering operation is performed in the automobile which travels on the road surface at a low speed, the steering resisting force larger than that in the case where the process speed is high is exerted from the belt member on the steering roller. For this reason, even when the steering resisting force is suppressed within a tolerable range at a normal process speed as described in JP-A 2002-2999, the vibration of the steering roller and the instability of the steering control become problematic in the case where the process speed is lowered.

SUMMARY OF THE INVENTION

A principal object of the present invention is to provide an image forming apparatus capable of outputting a high-quality image by precisely controlling lateral deviation (lateral movement) of a belt member without generating vibration of a steering roller and instability of steering control even in the case where a rotational speed of the belt member is set at a low level.

According to an aspect of the present invention, there is provided a belt driving apparatus comprising: an endless belt member; a belt driving portion for driving the belt member to move the belt member in an endless path at a variable traveling speed; a steering roller, provided tiltably while stretching the belt member, for steering the belt member during traveling; a steering driving portion for tilting the steering roller at a variable tilting speed; and a controller for setting the tilting speed, when the steering roller is tilted through a certain angle, so as to be higher when the traveling speed of the belt member is a first traveling speed than when the traveling speed of the belt member is a second traveling speed lower than the first traveling speed.

In the belt driving apparatus and the image forming apparatus according to the present invention, in the case where the rotational speed of the belt member is low, the steering roller is tilted slowly and therefore a steering resisting force acting on the steering roller is not increased. The steering resisting force is a frictional resistance per unit time when a difference in steering circumference among positions with respect to a rotational axis direction of the steering roller is canceled with friction, and therefore the steering resisting force can be lowered by prolonging a time required for the steering.

Therefore, even in the case where the rotational speed of the belt member is set at the low level, the high-quality image can be outputted by precisely controlling the lateral deviation of the belt member without generating the vibration of the steering roller and the instability of the steering control.

These and other objects, features and advantages of the present invention will become more apparent upon a consideration of the following description of the preferred embodiments of the present invention taken in conjunction with the accompanying drawings.

Figure 4:
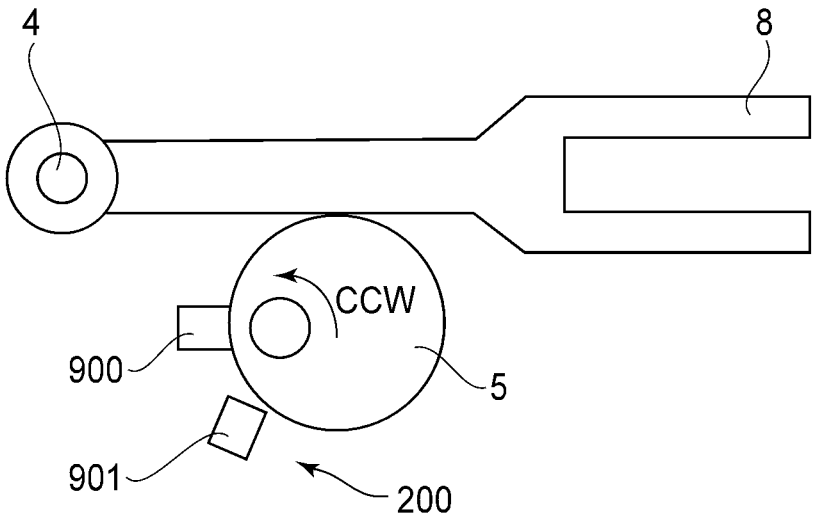
Figure 4:
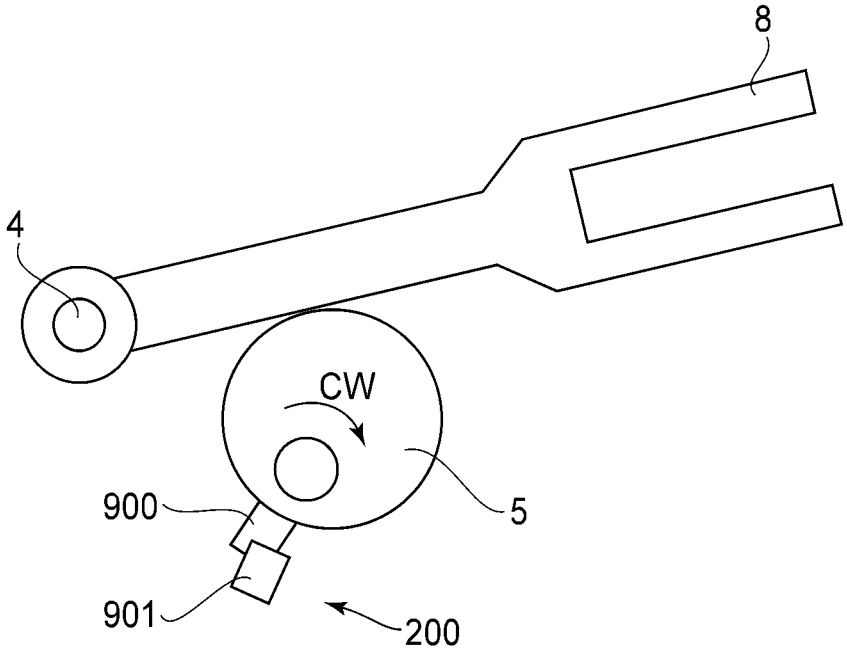

Parts (a) and (b) of FIG. 4 are illustrations of setting of a home position of a steering roller.

Figure 5:
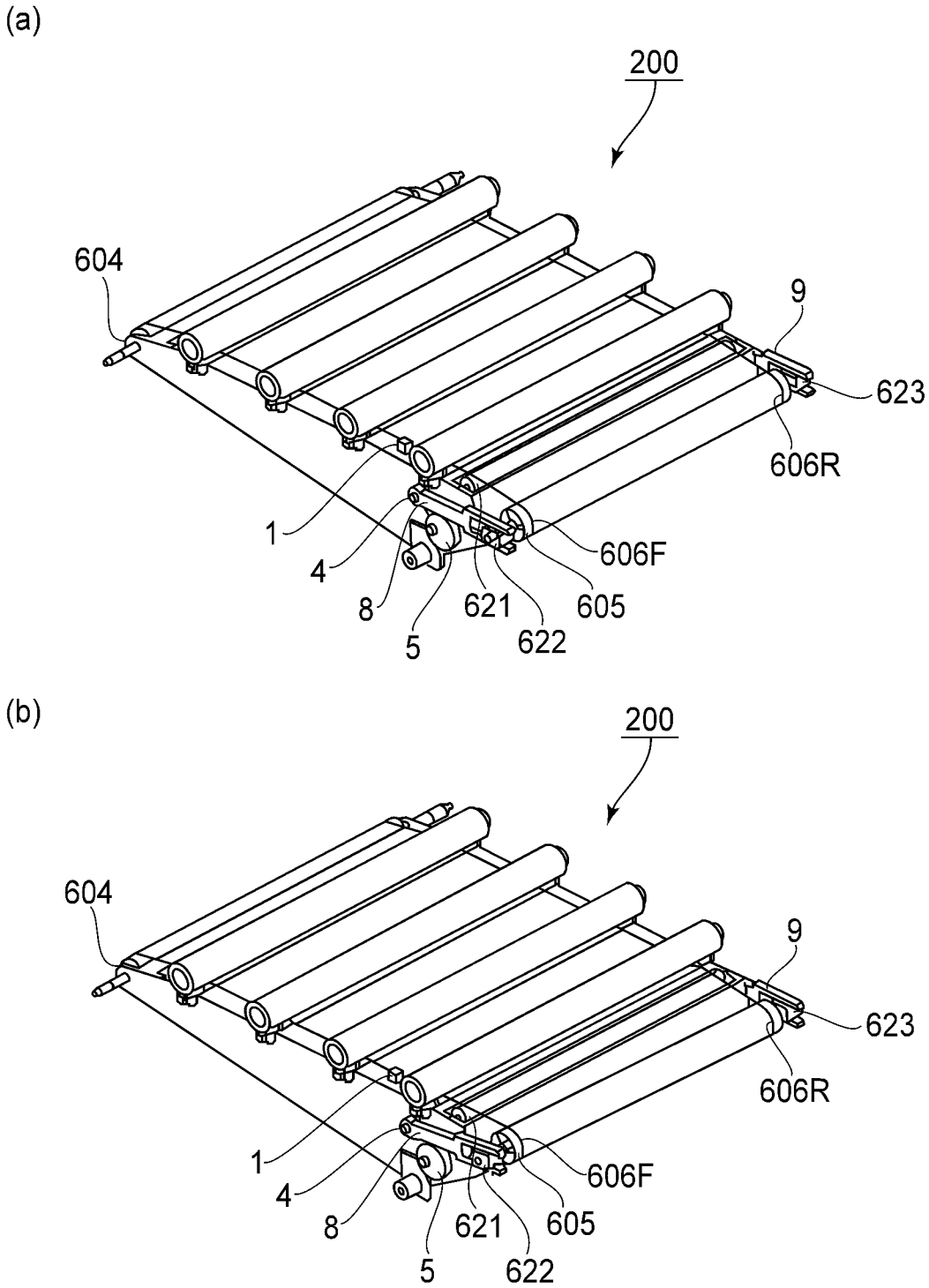

Parts (a) and (b) of FIG. 5 are illustrations of an amount of tilting of the steering roller.

Figure 6:
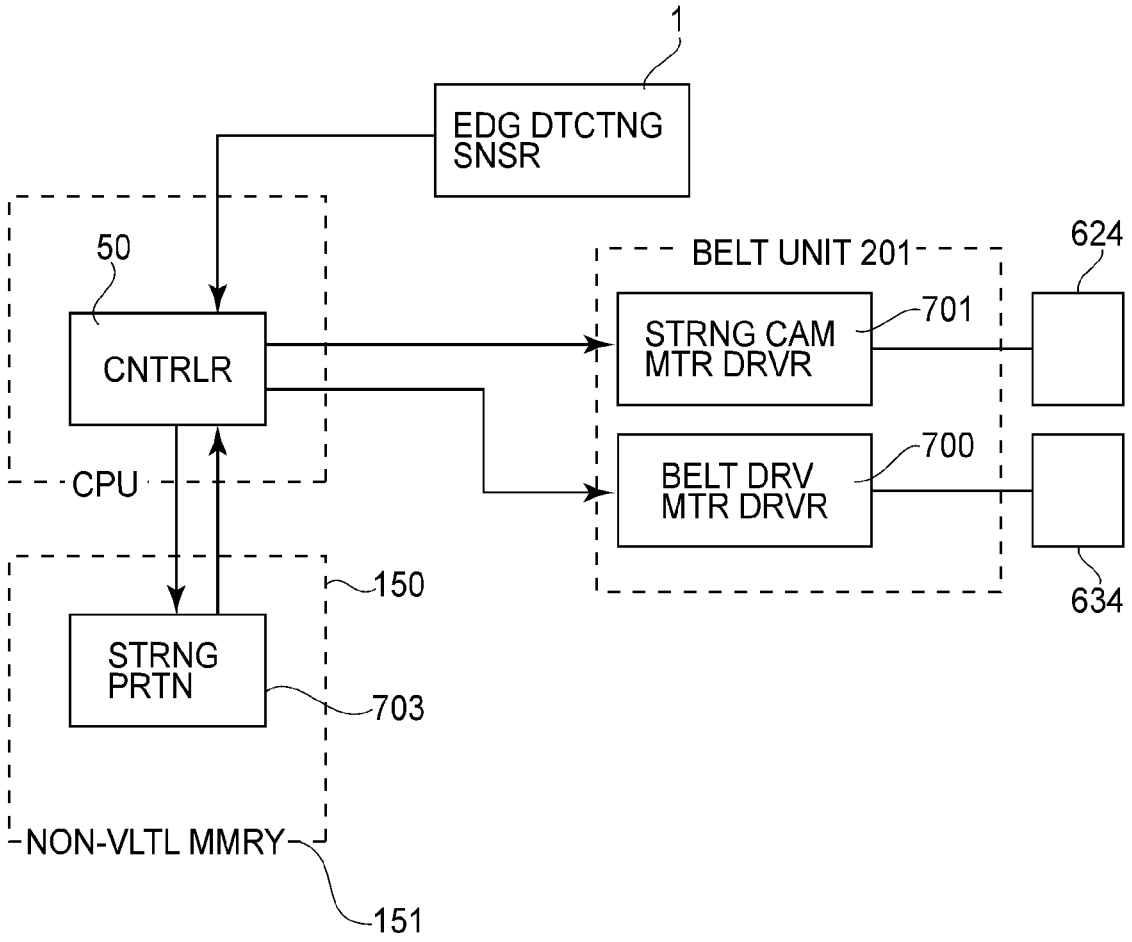

FIG. 6 is a block diagram of belt conveyance control in Embodiment 1.

Figure 7:
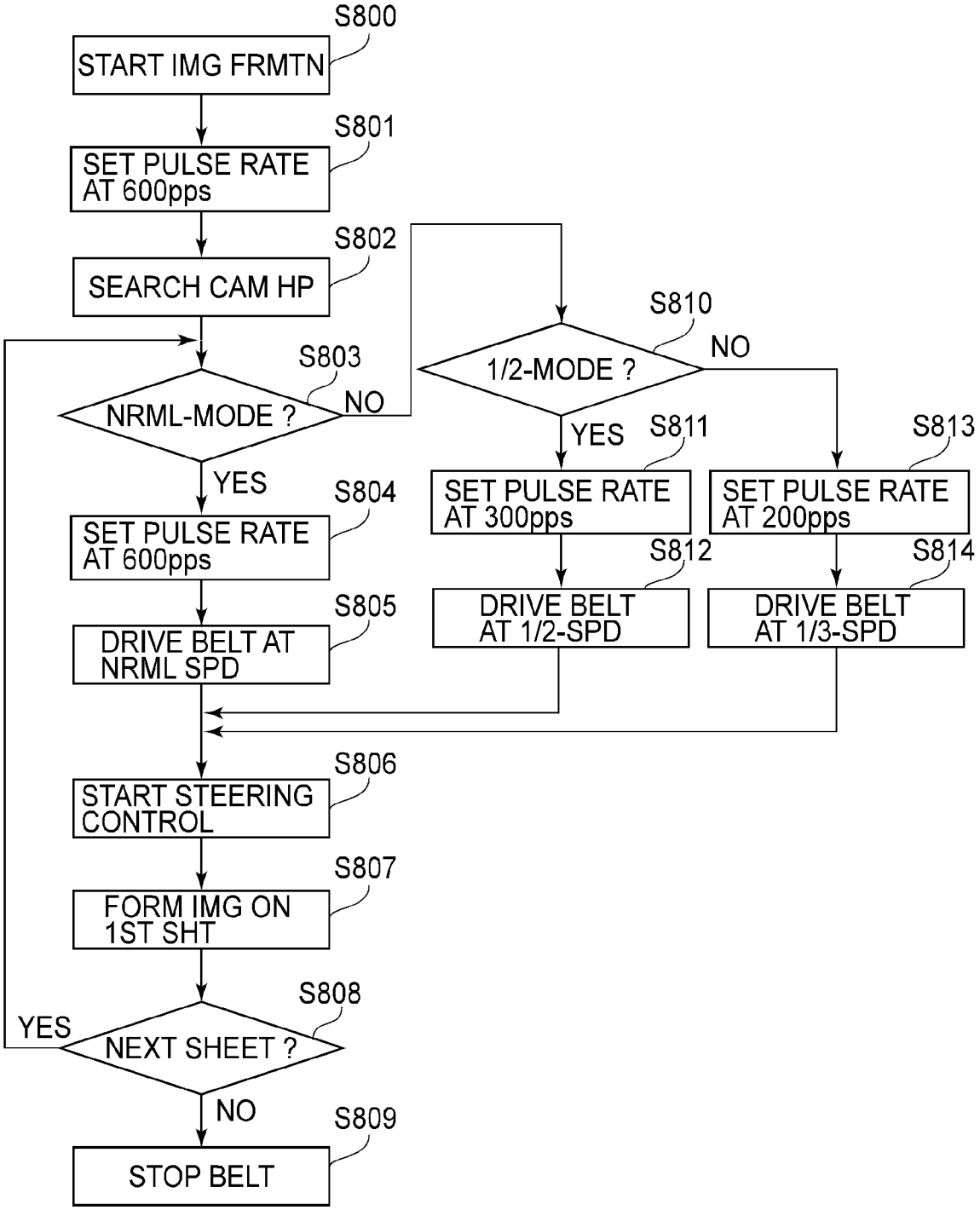

FIG. 7 is a flow chart of the belt conveyance control in Embodiment 1.

Figure 8:
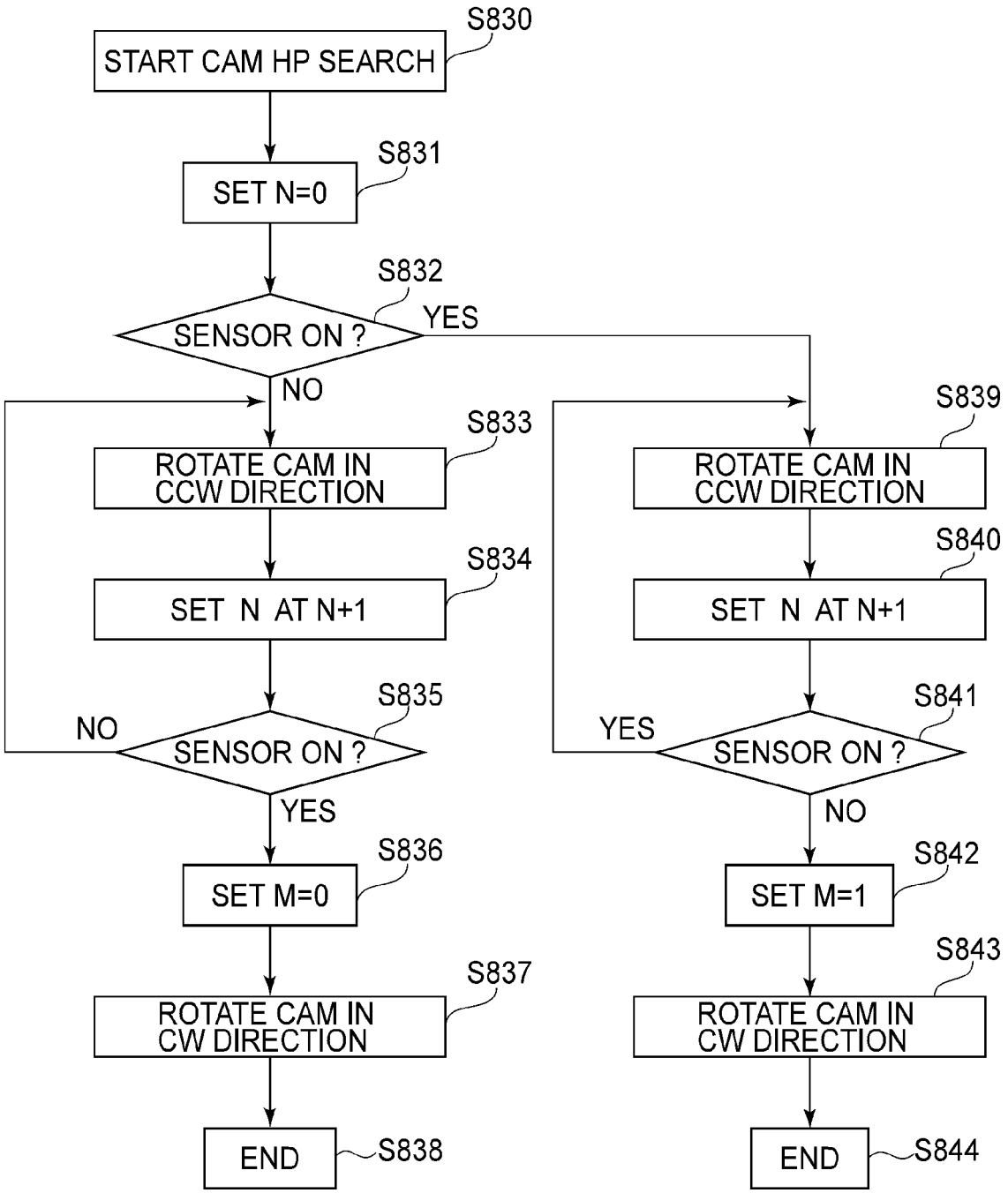

FIG. 8 is a flow chart of home position detection control.

Figure 9:
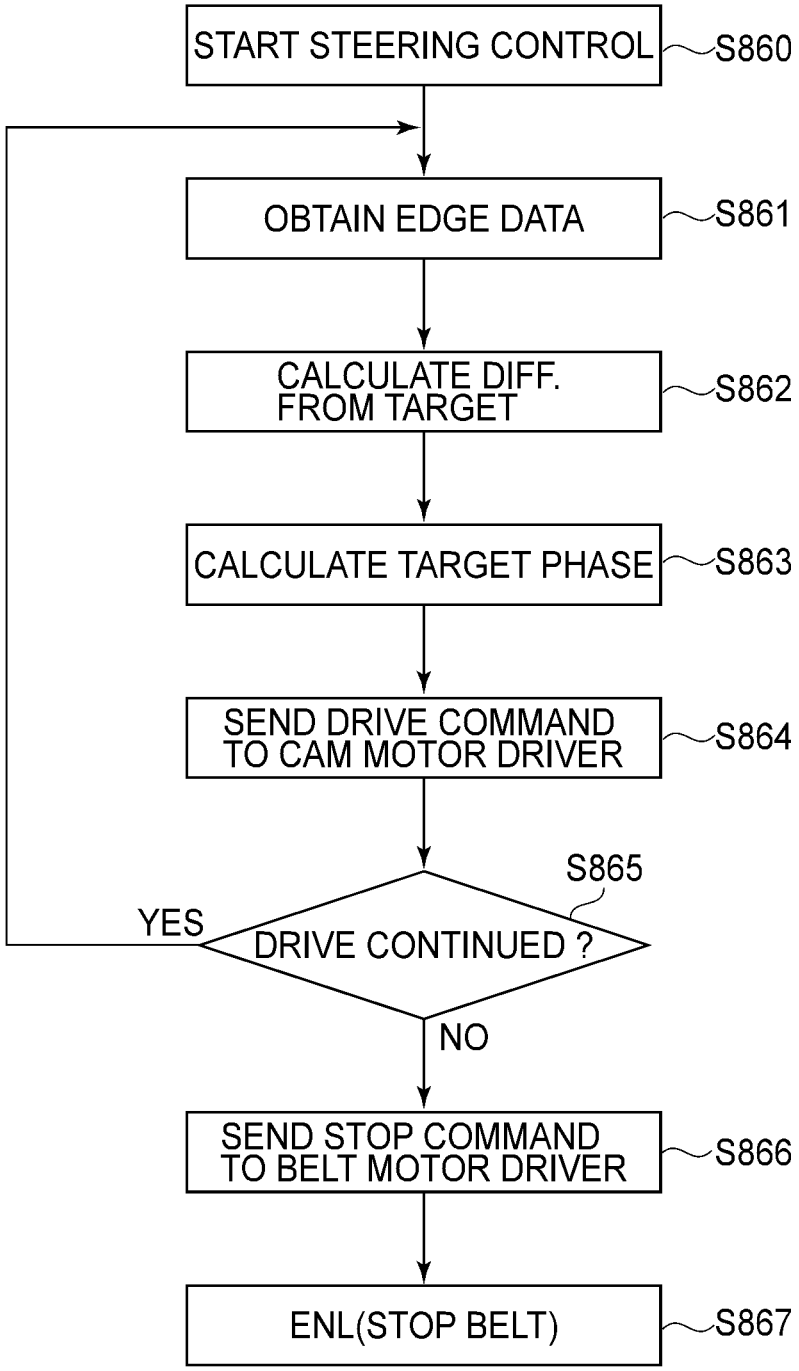

FIG. 9 is a flow chart of lateral deviation control of a belt.

Figure 10:
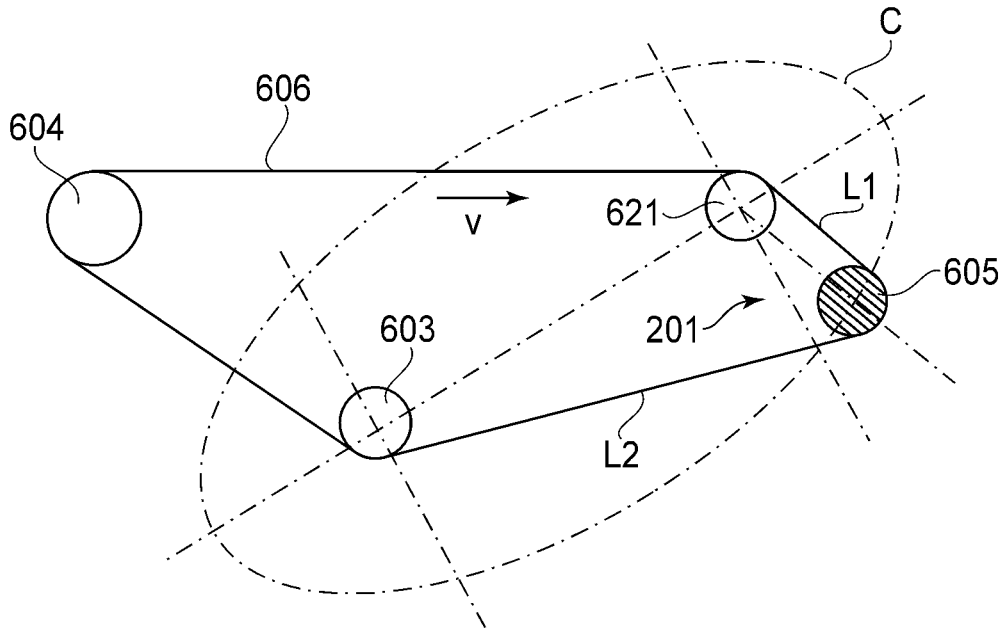
Figure 10:
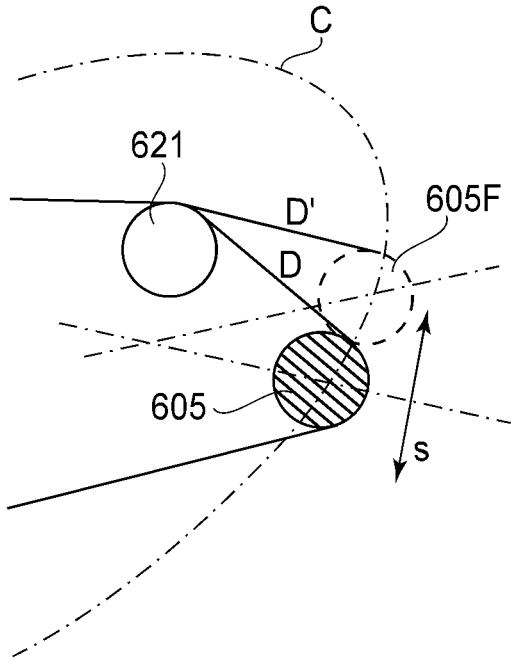

Parts (a) and (b) of FIG. 10 are illustrations of a tilting locus of the steering roller in the lateral deviation control.

Figure 11:
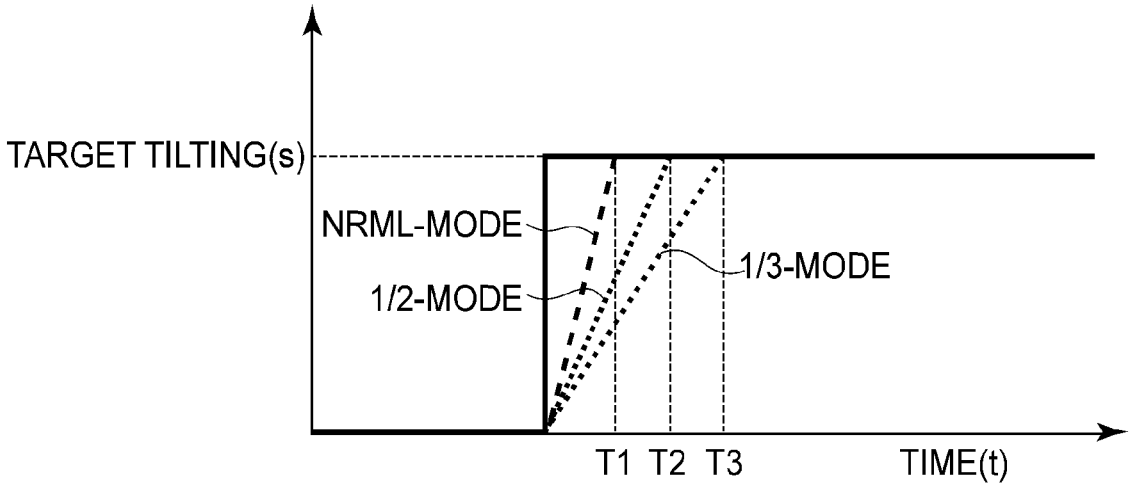

FIG. 11 is an illustration of tilting speed control of the steering roller in Embodiment 1.

Figure 12:
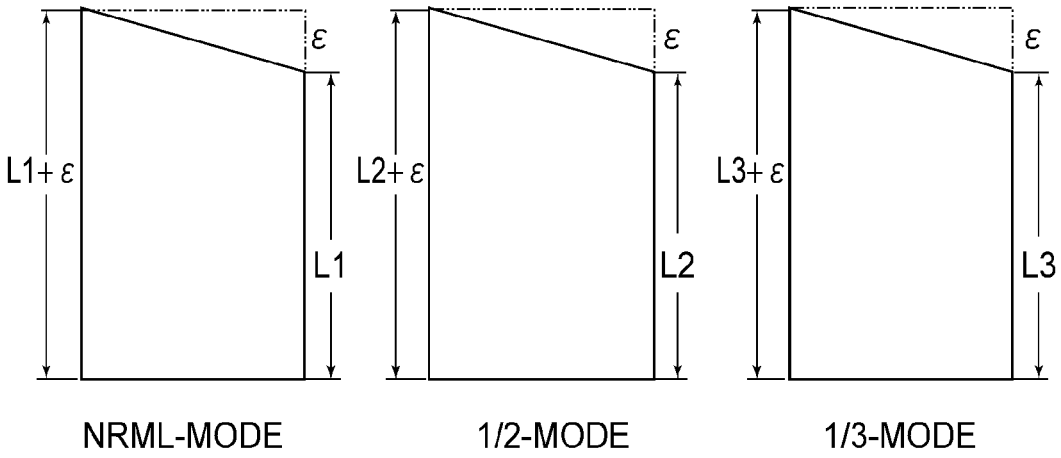

FIG. 12 is an illustration of a steering load in each mode in Embodiment 1.

Figure 13:
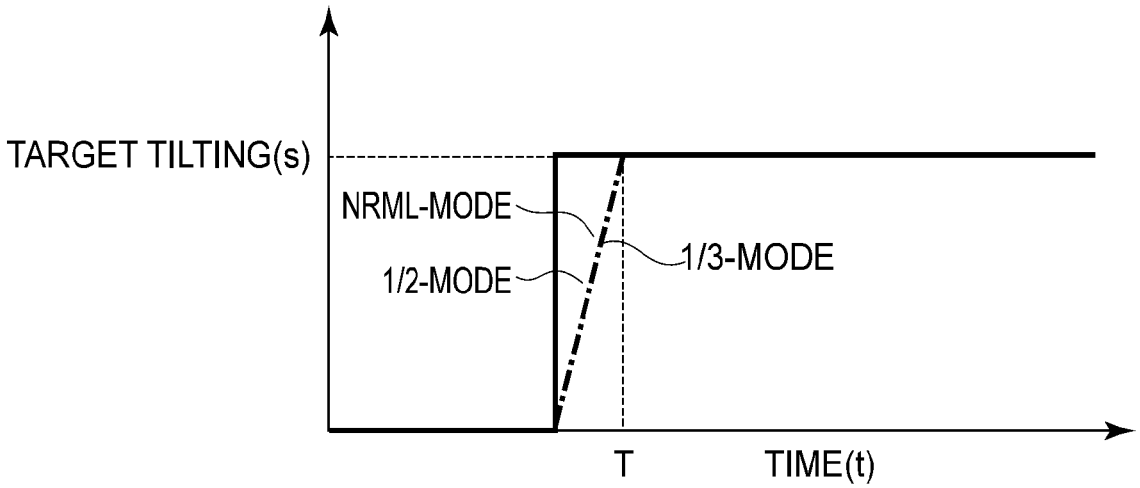

FIG. 13 is an illustration of tilting speed control of the steering roller in Comparative Embodiment.

Figure 14:
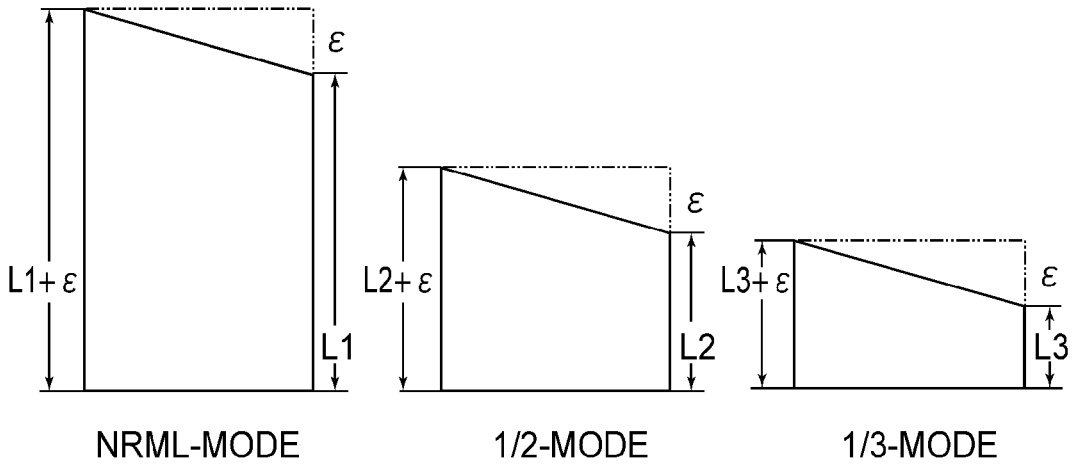

FIG. 14 is an illustration of a steering load in each mode in Comparative Embodiment.

DESCRIPTION OF THE PREFERRED EMBODIMENTS

Embodiments of the present invention will be described in detail with reference to the drawings. The present invention can also be carried out in other embodiments in which a part or all of constituent elements are replaced with alternative constituent elements so long as an angular speed of tilting of a steering roller is set at a low level when a rotational speed of a belt member is switched to a low speed.

Therefore, the belt member may be any of an intermediary transfer belt, a recording material conveyance belt, a transfer belt or a fixing belt. Further, the image forming apparatus can be carried out irrespective of its types such as a tandem type/one-drum type, intermediary transfer type/recording material conveyance type, an electrostatic image forming system, a developing system, and a transfer system. In the recording material conveyance system, at an image forming portion, in addition to an electrophotographic type, it is also possible to employ an offset printing type, an ink jet type or the like.

In this embodiment, only a principal portion relating to toner image formation and transfer will be described but the present invention can be carried out in image forming apparatuses in various fields, such as printers, various printing machine, copying machines, facsimile machines and multi-function machines by additionally providing necessary device, equipment and casing structure.

<Image Forming Apparatus>

Figure 1:
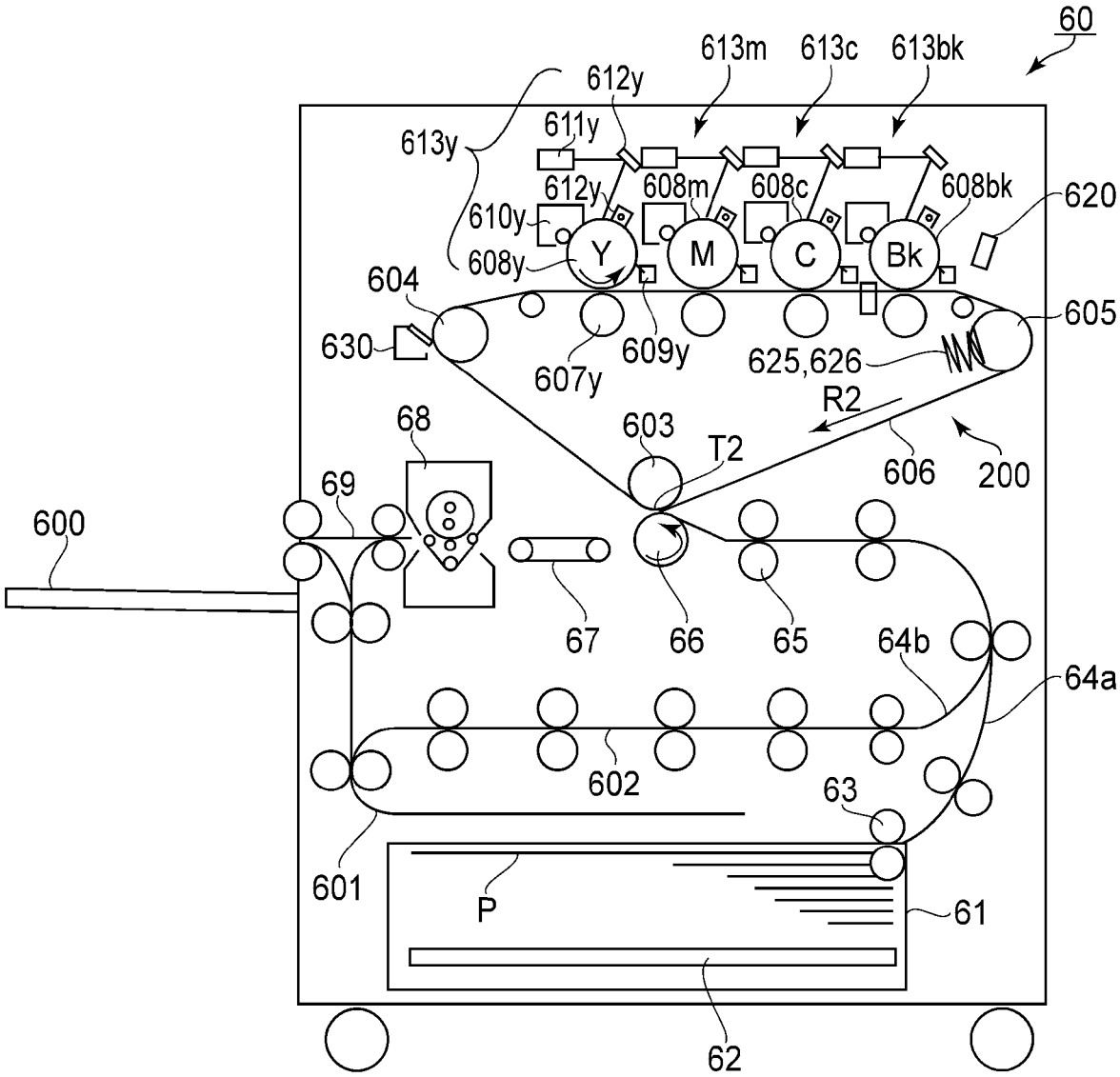
FIG. 1 is an illustration of a structure of an image forming apparatus.

FIG. 1 is an illustration of a structure of an image forming apparatus. As shown in FIG. 1, an image forming apparatus 60 is an intermediary transfer type full-color printer of the tandem type in which image forming portions 613*y* for yellow (Y), 613*m* for magenta (M), 613*c* for cyan (C) and 613*bk* by black (Bk) are juxtaposed along an intermediary transfer belt 606.

At the image forming portion 613*y*, a yellow toner image is formed on a photosensitive drum 608*y* and then is transferred onto the intermediary transfer belt 606. At the image forming portion 613*m*, a magenta toner image is formed on a photosensitive drum 608*m* and then is transferred onto the intermediary transfer belt 606. At the image forming portions 613*c* and 613*bk*, a cyan toner image and a black toner image are formed on photosensitive drums 608*c* and 608*bk*, respectively, and there are transferred onto the intermediary transfer belt 606.

A secondary transfer roller 66 is contacted to the intermediary transfer belt 606 supported by an opposite roller 603 to form a secondary transfer portion T2. A recording material P drawn out from a recording material cassette 61 is separated one by one by a separating roller 63 and is conveyed to a registration roller 65. The registration roller 65 sends the recording material P to the secondary transfer portion T2 by timing the recording material P to the toner image on the intermediary transfer belt 606. During a process in which the recording material P is nip-conveyed through the secondary transfer portion T2, a positive DC voltage is applied to the secondary transfer roller 66, so that a full-color toner image is secondary-transferred from the intermediary transfer belt 606 onto the recording material P. A transfer residual toner remaining on the intermediary transfer belt 606 without being transferred onto the recording material P is collected by a belt cleaning device 630.

The recording material P on which the four color toner images are secondary-transferred is curvature-separated from the intermediary transfer belt 606 and is sent into a fixing device 68. The fixing device 68 adds a heating effect, by a heating source such as a heater, on the recording material P under predetermined pressure, so that the toner images melt-fixed on the recording material P. The recording material P on which the image is fixed is, in the case of one side (surface) image formation, discharged onto a sheet discharge tray 600 through a branch conveying device 69.

However, in the case of both side (surface) image formation, the recording material P is sent to a reverse conveying device 601 and leading and trailing ends thereof are replaced by a switch-back operation, so that the recording material P is conveyed to a both side conveying path 602. Thereafter, the recording material P is conveyed through a sheet re-feeding path 64*b* to merge into the registration roller 65 to be sent to the secondary transfer portion T2, where the toner images are transferred also on the back surface of the recording material P and then the image is fixed on the recording material P by the fixing device 68.

The image forming portions 613*y*, 613*m*, 613*c* and 613*bk* have the substantially same constitution except that the colors (yellow, magenta, cyan and black) of the toners used in developing devices (610*y* and the like) are different from each other. In the following, the image forming portion 613*y* is described and other image forming portions 613*m*, 613*c* and 613*bk* are omitted from redundant description.

The image forming portion 613*y* includes, around the photosensitive drum 608*y*, a corona charger 612*y*, an exposure device 611*y*, the developing device 610*y*, a transfer roller 607*y* and a drum cleaning device 609*y*. The photosensitive drum 608*y* includes an organic photoconductor (OPC) on a surface of an aluminum pipe (cylinder) and rotates in an indicated arrow direction at a predetermined process speed. The corona charger 612*y* irradiates the surface of the photosensitive drum 608*y* with charged particles by corona discharge, thus charging the surface of the photosensitive drum 608*y* to a uniform negative dark-portion potential VD. The exposure device 611*y* scans the surface of the photosensitive drum 608*y* with a laser beam, obtained by subjecting to ON-OFF modulation scanning line image data developed from a separated color image for an image, through a rotating mirror to write (form) an electrostatic image for the image on the surface of the photosensitive drum 608*y*. The developing device 610*y* develops the electrostatic image by supplying the toner to the photosensitive drum 608*y*, so that the toner image is formed.

The transfer roller 607*y* is contacted to an inside surface of the intermediary transfer belt 606 to form a toner image transfer portion between the photosensitive drum 608*y* and the intermediary transfer belt 606. By applying a positive DC voltage, which is opposite in polarity to the charge polarity of the toner, to the transfer roller 607*y*, the toner image carried on the photosensitive drum 608*y* is transferred onto the intermediary transfer belt 606. The drum cleaning device 609*y* collects a transfer residual toner remaining on the photosensitive drum 608*y* by rubbing the surface of the photosensitive drum 608*y* with a cleaning blade.

<Intermediary Transfer Unit>

Figure 2:
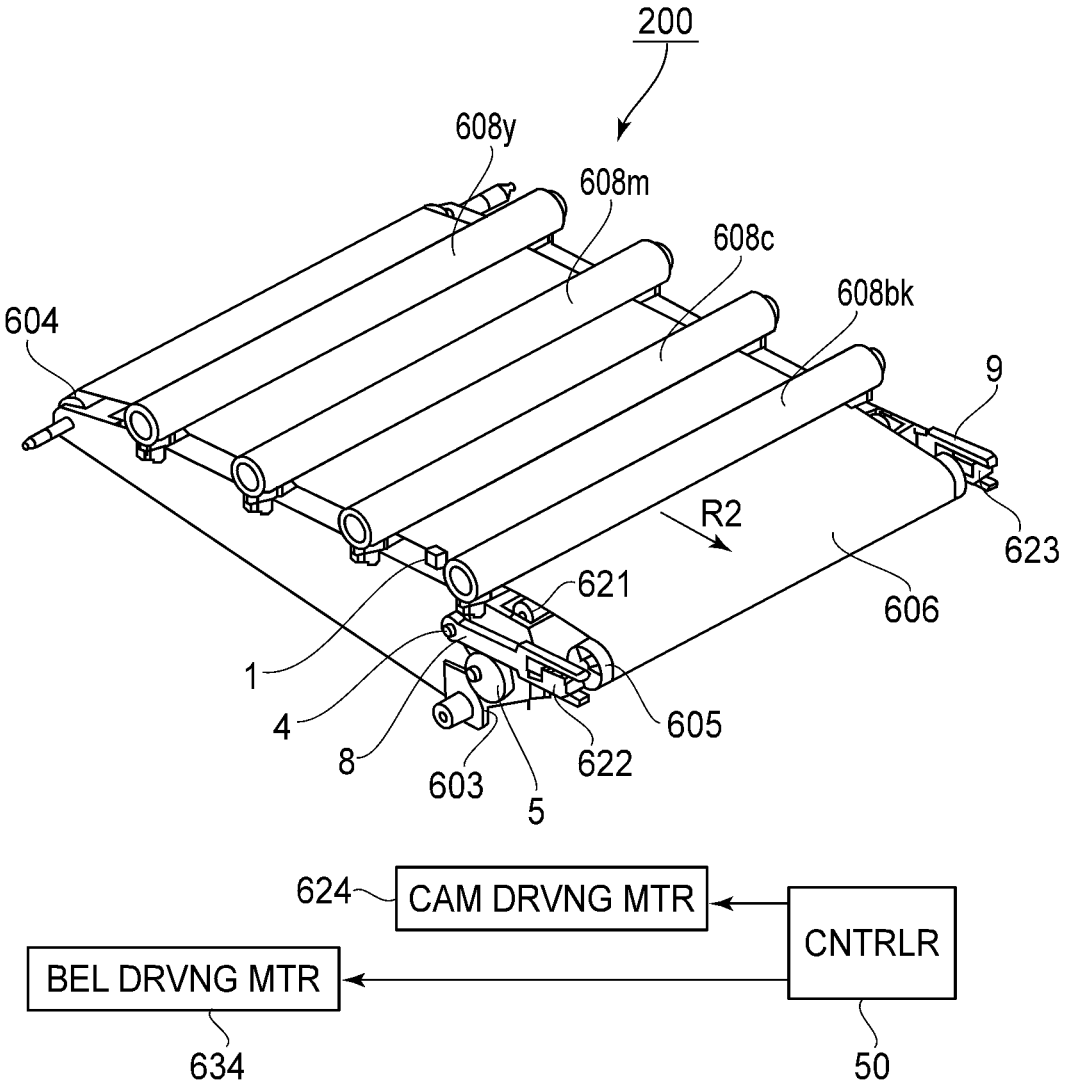
FIG. 2 is an illustration of a structure of an intermediary transfer unit.
Figure 3:
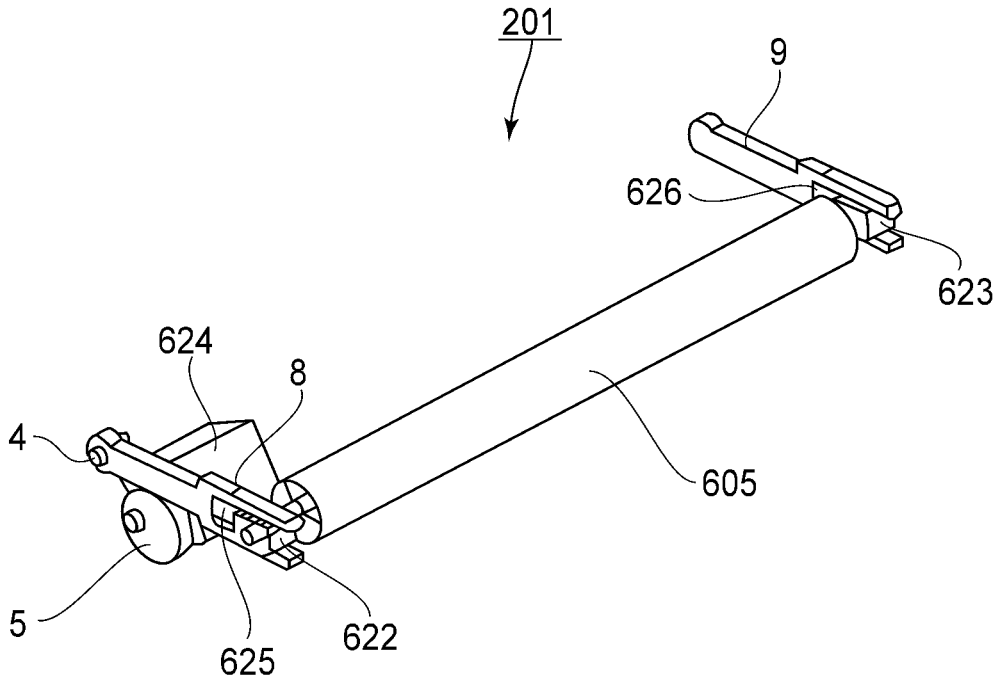
FIG. 3 is an illustration of a structure of a steering mechanism.

FIG. 2 is an illustration of a structure of an intermediary transfer unit. FIG. 3 is an illustration of a structure of a steering mechanism. With respect to the intermediary transfer belt, lateral deviation control for controlling lateral movement of the intermediary transfer belt is effected by detecting a positional fluctuation of a belt edge surface or the like and by providing an amount of tilting to the steering roller. Such lateral deviation control is effective in preventing breakage of the belt due to lateral offset.

As shown in FIG. 2, a belt driving motor 634 which is an example of a belt driving portion drives the intermediary transfer belt 606 which is an example of an endless belt member at a variable rotational speed. The steering roller 605 stretches the intermediary transfer belt 606 and is disposed tiltably. A steering cam driving motor 624 which is an example of a steering cam driving portion tilts the steering roller 605 at a variable tilting speed. A controller 50 which is an example of a steering control means controls the steering cam driving motor 624 to suppress the lateral movement of the rotating intermediary transfer belt 606.

An intermediary transfer unit 200 conveys the endless belt-like intermediary transfer belt 606. The intermediary transfer belt 606 is stretched and held at its inner peripheral surface by a plurality of roller members such as a driving roller 604, the opposite roller 603, an idler roller 621 and the steering roller 605. The driving roller 604 rotationally drives the intermediary transfer belt 606. A belt driving motor 634 rotationally drives the driving roller 604, so that the intermediary transfer belt 606 is caused to travel in an arrow R2 direction at a rotational speed V. The steering roller 605 is tilted, during the traveling drive of the intermediary transfer belt 606, by moving upward and downward rear-side end portions of the intermediary transfer belt 606, thus performing the function of corresponding the lateral deviation of the obliquely traveling intermediary transfer belt 606.

As shown in FIG. 3, an urging spring 625 is interposed between a steering arm 8 and a bearing portion 622, and an urging spring 626 is interposed between a fixed arm 9 and a bearing portion 623. The urging springs 625 and 626 hold the steering roller 605 by urging the steering roller 605 in a direction crossing a stretching surface of the intermediary transfer belt 606. As a result, the steering roller 605 also functions as a tension roller simultaneously, thus applying predetermined tension to the intermediary transfer belt 606.

As shown in FIG. 2, the idler roller 621 is disposed between the steering roller 605 and a primary transfer surface of each of the toner images contacting the photosensitive drums 608*y*, 608*m*, 608*c* and 608*bk*. The idler roller 621 suppresses a fluctuation of the primary transfer surface so that the primary transfer surface is not largely fluctuated with tilting of the steering roller 605. The primary transfer surface is a belt surface of the intermediary transfer belt 606 located at a position of the nip formed by the primary transfer roller (607*y* or the like) shown in FIG. 1.

Correspondingly to a belt edge position of the intermediary transfer belt 606, an edge detecting sensor 1 is provided in the intermediary transfer unit 200. The edge detecting sensor 1 detects the position of the intermediary transfer belt 606 with respect to a direction perpendicular to a conveyance direction of the intermediary transfer belt 606. The edge detecting sensor 1 detects a tilted amount of an arm-type contactor contacting the belt edge by a gap sensor, and outputs a voltage signal corresponding to an amount of movement of the edge (i.e., the amount of the lateral deviation of the intermediary transfer belt 606). Incidentally, a linear image sensor, a photointerruptor, an ultrasonic range sensor, and the like may also be used.

The controller 50 changes, in real time, a tilted angle of the steering roller 605 depending on the lateral deviation amount of the belt detected by the edge detecting sensor 1, thus effecting the lateral deviation control of the intermediary transfer belt 606. The controller 50 changes the tilted angle of the steering roller 605 in real time so that a lateral deviation speed of the belt converges to 0 while canceling the lateral deviation amount of the belt detected by the edge detecting sensor 1.

As shown in FIG. 3, the steering roller 605 is supported by the steering mechanism 201 at its end portions with respect to its rotational axis direction. The steering mechanism 201 tilts the steering roller 605 in a direction crossing the belt stretching surface of the intermediary transfer belt 606, thus changing parallelism between the steering roller 605 and another roller member in real time.

The steering roller 605 is rotatably supported by the bearing portions 622 and 623 provided at its end portions. The rear-side bearing portion 622 is held by a swinging end of the steering arm 8 mounted swingably is moved upward and downward depending on a degree of swinging of the steering arm 8. The front-side bearing portion 623 is held by the fixed arm 9 and supports the steering roller 605 tiltably at a fixed-height position.

The steering arm 8 is always urged toward a cam surface of the steering cam 5 by an unshown tension spring and therefore is continuously contacted to the cam surface of the steering cam 5, so that its rotational movement end is moved upward and downward depending on an angle of rotation of the steering cam 5. A variable range of alignment of the steering roller 605 is determined by a cam profile of the steering cam 5 and a distance from a rotational movement center 4 to the steering roller 605.

The steering cam 5 moves, on the basis of a fixed end-side bearing portion 623 of the steering roller 605, another end-side bearing portion 622, thus tilting the steering roller 605 so as to destroy axial alignment of the steering roller 605. The steering cam 5 is mounted on a shaft of the steering cam driving motor 624, thus being capable of controlling the angular position arbitrarily.

The steering cam driving motor 624 is constituted by a pulse motor. The controller 50 changes a frequency of a pulse to be supplied to the pulse motor, thus setting the tilting speed of the steering roller 605. The steering cam driving motor 624 is the pulse motor (stepping motor) and therefore its rotational speed is switched by the frequency (pulse rate) of the supplied pulse. The steering cam driving motor 624 is the pulse motor (stepping motor) and therefore in a state in which the steering roller 605 is tilted, the tilted angle of the steering roller 605 can be retained.

The controller 50 changes an angular speed of the tilting of the steering roller 605 by switching the frequency, at a plurality of levels, of the pulse to be supplied to the steering cam driving motor 624. The controller 50 detects the lateral movement of the intermediary transfer belt 606 on the basis of the output of the edge detecting sensor 1 and allocates an optimum value to a real-time alignment amount of the steering roller 605 on the basis of a maximum steering amount required for correcting the lateral movement, or the like.

<Detection of Origin (Home) Position>

Parts (a) and (b) of FIG. 4 are illustrations of setting of a home position of the steering roller. Parts (a) and (b) of FIG. 5 are illustrations of an amount of tilting of the steering roller. In FIG. 5, in order to make the figure easy to see, the intermediary transfer belt 606 is illustrated by only curves indicating its front-side edge 606F and its rear-side edge 606R.

As shown in (a) of FIG. 4, on the steering cam 5, a flag 900 which is to be rotated integrally with the steering cam 5 is provided. In the intermediary transfer unit 200, an HP (home position) sensor 901, which is an optical sensor to be light-blocked by the flag 900 when the steering cam 5 is located at a predetermined angle from the home position, is provided.

As shown in FIG. 3, the motor drive pulse number of the steering cam driving motor 624 is controlled on the basis of the position where the flag 900 is detected by the HP sensor 901, so that the steering cam 5 is positioned at the home position shown in (a) of FIG. 4. Then, on the basis of the home position shown in (a) of FIG. 4, the motor drive pulse number is controlled, so that the steering cam 5 is rotationally controlled to an arbitrary angular position with respect to CW direction and CCW direction.

As shown in (a) of FIG. 5, the steering roller 605 is positioned at the home position to actuate the intermediary transfer belt 606, so that the lateral deviation control of the intermediary transfer belt 606 by the steering roller 605 is started.

As shown in (b) of FIG. 5, when the lateral deviation amount is generated for the intermediary transfer belt 606, the steering cam 5 is rotated to swing the steering arm 8, so that the steering roller 605 is tilted. The controller 50 swings the steering arm 8 while arbitrarily controlling the movement amount of the steering roller 605.

<Speed Switching>

In the lateral deviation control of the intermediary transfer belt 606, during the steering operation, rubbing is generated between the intermediary transfer belt 606 and the steering roller 605. For this reason, by a frictional force between the intermediary transfer belt 606 and the steering roller 605, stress was exerted on the belt surface or the steering mechanism, so that there was the case where disturbance of the transfer image and a lowering in steering control property were caused.

Such rubbing frictional force leads to a load on the steering mechanism as it is and therefore, in the case where the rubbing frictional force is large and rigidity of the steering mechanism is low, the lowering in steering control property is caused. The rigidity of the steering mechanism is required to be ensured on the assumption that the rubbing frictional force becomes large.

In the image forming apparatus 60, in image formation on plain paper, the process speed of 300 mm/sec is set but in image formation on thick paper, the process speed of 150 mm/sec is set in order to optimize the fixing. In this case, the rubbing frictional force tends to increase in an operation in a low-speed mode, such as a thick paper mode.

Further, the increase in rubbing frictional force caused reinforcing of the steering mechanism, upsizing of the steering cam driving motor 624 and an increase in electric power consumption, thus leading to increases in cost and size of the steering mechanism.

Therefore, in Embodiment 1, in a belt conveying mechanism for conveying the endless belt member, a tilting speed of the steering roller is made variable in the steering mechanism for changing parallelism of at least one steering roller in real time. The tilting speed is set at a low level in an operation in an image forming mode in which a conveyance speed of the belt member is slow.

Further, in the case where the steering roller is tilted in a state in which the belt conveyance is in rest, the tilting speed is set at a further low level, and before the belt conveyance is started, the tilted angle of the steering roller is returned to an angle at the position before the tilting, so that stress of the steering mechanism is eliminated.

Embodiment 1

FIG. 6 is a block diagram of belt conveyance control in Embodiment 1. FIG. 7 is a flow chart of the belt conveyance control in this embodiment. FIG. 8 is a flow chart of home position detection control. FIG. 9 is a flow chart of lateral deviation control of the belt.

As shown in FIG. 6, the controller 50 controls the steering cam driving motor 624 on the basis of the output of the edge detecting sensor 1, thus executing the lateral deviation control of the intermediary transfer belt 606. The controller 50 sets the tilting speed of the steering roller 605 at a lower level with a lower rotational speed of the intermediary transfer belt 606.

(Belt Conveyance Control)

As shown in FIG. 2, in an operation in a normal-speed mode which is an example of a first mode, image formation is executable on plain paper by rotating the intermediary transfer belt 606 at a first rotational speed. In an operation in a ½-speed mode which is an example of a second mode, image formation is executable on thick paper by rotating the intermediary transfer belt 606 at a second rotational speed lower than the first rotational speed. The controller 50 sets the tilting speed of the steering roller 605 in the operation in the ½-speed mode so as to be lower than the tilting speed of the steering roller 605 in the operation in the normal-speed mode.

As shown in FIG. 7 with reference to FIG. 6, the controller 50 sets, when an image forming job is inputted into the image forming apparatus 60 (S800), a pulse rate for pulse motor drive of 600 pps in a steering cam driving motor driver 701 (S801).

Then, the controller 50 executes a steering cam HP searching operation in order to determine an absolute position of the steering cam 5 (S802). For this reason, even when a rotatable phase of the steering cam 5 becomes uncertain during stand-by of the image forming job, the determination of the rotational phase is always made during actuation and therefore an exciting current of the steering cam driving motor 624 can be discontinued during the stand-by, so that it is possible to realize prevention of temperature rise of the motor and energy saving.

The controller 50 discriminates, when the steering cam HP searching operation (S802) is ended, the speed mode designated by the image forming job (S803, S810).

The controller 50 sets, in the case of the normal-speed mode (YES of S803), the pulse rate of the steering cam driving motor at 600 pps (S804) and thereafter drives the intermediary transfer belt 606 at the normal speed of 300 mm/sec (S805).

The controller 50 sets, in the case of ½-speed mode for thick paper or the like (YES of S810), the pulse rate of the steering cam driving motor at 300 pps (S811) and thereafter drives the intermediary transfer belt 606 at ½-speed of 150 mm/sec (S812).

The controller 50 sets, in the case of ⅓-speed mode for coated paper or the like (NO of S810), the pulse rate of the steering cam driving motor at 200 pps (S813) and thereafter drives the intermediary transfer belt 606 at ⅓-speed of 100 mm/sec (S814).

In either case, the lateral deviation control of the belt is started simultaneously with start of the drive of the intermediary transfer belt 606 (S806).

Thereafter, the image is formed on a first sheet of the recording material (S807). In the case where the image formation instruction is inputted also with respect to a second sheet or later of the recording material (YES of S808), the sequence is returned to the step of S803 and then the same operation is repeated while changing the speed every sheet of the recording material P. When the image formation of a final sheet is ended (NO of S808), the drive of the intermediary transfer belt 606 is stopped to end the belt conveyance control (S809).

In the belt conveyance control in Embodiment 1, the rubbing frictional force between the steering roller 605 and the intermediary transfer belt 606 in the lateral deviation control of the intermediary transfer belt 606 during the thick paper mode (low-speed mode) can be suppressed to the same level as that during the plain paper mode (normal-speed mode).

For this reason, there is no need to enhance the rigidity by changing the structures of the intermediary transfer unit 200 and the steering arm 8. Thus, increases in cost and size of the intermediary transfer unit 200 due to the change in structure can be avoided.

(Home Position Detection Control)

As shown in FIG. 2, in the operation in the normal-speed mode as the first mode, the intermediary transfer belt 606 is rotated at a first rotational speed to form the image on the recording material. In home position detection contact which is an example of an operation in a second mode, in advance of actuation of the intermediary transfer belt 606, the steering roller 605 is tilted in a rest state of the intermediary transfer belt 606 to detect an origin (home) position of the steering roller 605.

The controller sets the tilting speed of the steering roller 605 in the operation in the home position detection control at a value lower than that of the tilting speed of the steering roller 605 in the operation in the normal-speed mode. The controller 50 returns, after the origin position of the steering roller 605 is detected by the home position detection control, the tilted angle to the angle before the start of the tilting to actuate the intermediary transfer belt 606.

As shown in FIG. 8 with reference to FIG. 6, the controller 50 sets, when instruction of steering cam HP search is provided (S830), a search drive pulse number N, which is a variable for counting an amount of movement of the cam during the search, at 0 (S831). At this time, the intermediary transfer belt 606 is in a rest state of 0 mm/sec and therefore a pulse rate of the steering cam driving motor 624 is set at 50 pps lower than that in the thick paper mode.

As shown in (a) of FIG. 4, the controller 50 rotates, in the case where the phase of the steering cam 5 is located at a position where the HP sensor 901 is not light-blocked by the flag 900 (NO of S832), the steering cam 5 in the CCW direction (S833).

As shown in (b) of FIG. 4, the controller 50 increments, until the HP sensor 901 is light-blocked to be turned on (NO of S835), the drive pulse number N by 1 pulse to rotate the steering cam 5 in the CCW direction (S833, S834).

The controller 50 determines, when the HP sensor 901 is turned on (YES of S835), the position as an absolute phase 0 of the cam phase and sets a variable (cam phase count M) for indicating the cam phase at 0 (S836).

The controller 50 finds the absolute phase and then rotates the steering cam 5, in a direction opposite from the direction of the movement during the search by the pulse number N correspondingly to which the steering cam 5 is moved, to return the steering cam 5 to the position before the search (S837).

As shown in (b) of FIG. 4, the controller 50 rotates, in the case where the steering cam 5 is already located during the start of the search at a position where the HP sensor 901 is turned on (YES of S832), the steering cam 5 in the CW direction (S839).

The controller 50 increments, until the HP sensor 901 is turned off (YES of S841), the drive pulse number N by 1 pulse to rotate the steering cam 5 in the CW direction (S839, S840). The controller 50 determines, when the HP sensor 901 is turned off (NO of S841), the position as a position where the steering cam 5 is rotated, by an angle corresponding to 1 pulse in the CW direction, from the absolute phase origin of the cam phase and sets a variable (cam phase count M) for indicating the cam phase at 1 (S842).

A movable amount of the steering cam 5 in the CCW direction is regulated so that the HP sensor 901 is turned on by the light-blocking with the flag 900 and thereafter is prevented from being turned off by further movement. Thus, even when the steering cam 5 is located at any phase at the time of the start of the HP search, the point of the absolute phase origin M=0 is always found, so that the phase of the steering cam 5 itself can be identified.

After the absolute phase is found, the steering cam 5 is rotated in a direction opposite from the direction of the movement during the search by the pulse number N correspondingly to which the steering cam 5 is moved, thus being to be returned to the position before the search (S843).

In the home position detection control in Embodiment 1, the pulse rate is made lower than that in the thick paper mode, so that loads on the intermediary transfer belt 606 and the steering cam drive motor 624 can be alleviated in the HP searching operation performed on the belt rest state. Further, the intermediary transfer belt 606 is actuated in a state in which the stress generated in the intermediary transfer unit 200 and the steering arm 8 is eliminated, so that it is possible to avoid an occurrence of large disturbance in the lateral deviation control caused by the stress elimination immediately after the actuation. The stress generated in the steering mechanism can be reduced, so that increases in cost and size of the image forming apparatus due to an increase in rigidity of the steering mechanism.

(Lateral Deviation Control of Belt)

As shown in FIG. 3, the controller 50 executes, on the basis of the output of the edge detecting sensor 1, the lateral deviation control of the intermediary transfer belt 606 by the steering mechanism 201.

As shown in FIG. 9 with reference to FIG. 6, the controller 50 obtains, when the lateral deviation control of the belt by the steering mechanism 201 is started (S860), belt edge position data of the edge detecting sensor 1 (S861).

The controller 50 calculates a difference between the obtained data and a preset target edge position (S862) and then calculates a target phase of the steering cam 5 in accordance with a computing (operation) rule of a so-called PID control (S863).

The controller 50 sends a drive command, for rotating the steering cam 5 to the target phase, to the steering cam drive motor driver 701 (S864).

The controller 50 repeats, during the drive operation of the intermediary transfer belt 606 (YES of S865), the operations in the control from S861 to S864 at a predetermined control interval.

When the image forming job and operations in various image adjusting modes are ended (NO of S865), a drive stop command is sent to the belt drive motor driver 701 (S866), so that the intermediary transfer belt 606 is stopped (S867). Thus, during the drive of the intermediary transfer belt 606, the lateral deviation control using the steering roller 605 is executed, so that the lateral offset of the intermediary transfer belt 606 is prevented.

<Effect of Steering Roller Tilting Speed Control>

Parts (a) and (b) of FIG. 10 are illustrations of a tilting locus of the steering roller in the lateral deviation control. FIG. 11 is an illustration of tilting speed control of the steering roller in this embodiment. FIG. 12 is an illustration of a steering load in each of modes in this embodiment. FIG. 13 is an illustration of tilting speed control of a steering roller in Comparative Embodiment. FIG. 14 is an illustration of a steering load in each of modes in Comparative Embodiment.

As shown in (a) of FIG. 10, a tilting locus of the steering roller 605 during the lateral deviation control is formed. When the steering roller 605 is tilted by the steering mechanism 201, under a constraint condition such that a circumferential length of the belt member is constant, an end of the steering roller 605 is moved along an elliptical locus indicated in the figure. On the ellipse with the front and rear roller members (621 and 603) as focal points, a relationship such that a stretching length of the belt member from the roller members (621 and 603) is constant is satisfied.

As shown in (b) of FIG. 10, when a tilting amounts along the elliptical locus c is provided to the steering roller 605, the end of the steering roller 605 moves to a position 605F. At that time, the belt circumferential length from the roller members (621 and 603 in (a) of FIG. 10) is constant but the end position of the steering roller 605 is changed between its original position to the position 605F and therefore the steering roller 605 is required to slide on the belt inner surface by a distance represented by the following equation.

$$D-D'=\epsilon$$

In order to obtain the target steering tilting amount s, the pulse motor for driving the steering cam is driven. As described above, the pulse rate of the steering cam driving motor 624 in this embodiment is as follows.

| | | |
|---|---|---|
| Plain paper: | normal-speed mode: | 600 pps |
| Thick paper: | ½-speed mode: | 300 pps |
| Coated paper: | ⅓-speed mode: | 200 pps |

As shown in FIG. 11, in this embodiment, by such switching of the pulse rate, a time required to move the end of the steering roller 605 until the steering tilting amount reaches the target tilting amount s varies every mode as indicated by T1, T2 and T3.

As shown in FIG. 12, in this embodiment, at the times T1, T2 and T3 in which the steering roller 605 is tilted to the target tilting amount s, the belt member is conveyed sequentially and therefore in actuality, the steering roller 605 rubs with the belt member by the distance ϵ while rolling on the belt member. When this is seen from the belt member side, the steering roller 605 is tilted while rolling with the locus as shown in FIG. 12. The belt member rolling distance is the product of each tilting time and each belt conveying speed and therefore is represented as follows.

$$L1=T1\times 300$$

$$L2=T2\times 150$$

$$L3=T1\times 100$$

However, as shown in FIG. 11, the following relationships are satisfied.

$$T1=1\times T1$$

$$T2=2\times T1$$

$$T3=3\times T1$$

Therefore, the following relationship is satisfied.

$$L1\approx L2\approx L3$$

Generally, a sliding resistance F generated in an object which tilts while rolling becomes larger with a smaller rolling distance and a larger tilting amount.

$$F\propto(L1+\epsilon)/L1$$

For this reason, in this embodiment, the sliding resistances F in the respective modes are substantially equivalent.

On the other hand, as shown in FIG. 13, in a steering tilting operation of a conventional art as Comparative Embodiment, the pulse rate of the steering cam driving motor 624 is set at 600 pps at all of the belt peripheral speeds. For this reason, a time required for the tilting amount s is T in all of the modes.

As shown in FIG. 4, also in Comparative Embodiment, the belt member rolling distance is the product of each tilting time and each belt conveying speed and therefore is represented as follows.

$$L1=T\times 300$$

$$L2=T\times 150$$

$$L3=T\times 100$$

For this reason, the sliding resistance F is increased in the order of the normal-speed mode, the ½-speed mode and the ⅓-speed mode.

$$(L1+\epsilon)/L1<(L2+\epsilon)/L2<(L3+\epsilon)/L3$$

As described above, in Comparative Embodiment, the load on the steering mechanism 201 is increased in the low-speed mode. On the other hand, in this embodiment, the load on the steering mechanism 201 can be made substantially equivalent.

As described above, in this embodiment, the stresses exerted on the belt member and the steering mechanism due to the sliding resistance between the belt member and the steering roller during the steering can be remarkably reduced. For this reason, suitable lateral deviation control of the belt can be realized without causing the increases in size and cost of the steering mechanism.

Embodiment 2

Embodiment 2 has the same constitution and control as those in Embodiment 1. However, the above-described home position detection control can be carried out also in an image forming apparatus in which the pulse rate of the pulse motor drive is fixed. With respect to the functional effect of eliminating the stress state generated between the steering mechanism 201 and the intermediary transfer unit 200 with the home position detection, the setting of the tilting speed of the steering roller 605 at the low level is not essential but the following constitutions (1) and (2) are essential.

(1) The endless belt member, the steering roller which stretches the belt member and which is disposed tiltably, and the steering control means for controlling the tilting of the steering roller suppress the lateral movement of the rotating belt member are provided.

(2) An actuation control means for actuating the belt member after the steering roller origin position is detected by tilting the steering roller in the rest state of the belt member and then the steering roller is returned to the position of the tilting angle before the detection start is provided.

When the origin position is detected by tilting the steering roller in the belt member rest state, the steering mechanism 201 and the intermediary transfer unit 200 are in the stress state due to the static friction resistance. When the intermediary transfer belt 606 is actuated in this state, the stress state is autonomously eliminated immediately after the rotation start, so that large disturbance due to the lateral movement is generated in the intermediary transfer belt 606. This distance converges with the elimination of the stress state and therefore when the lateral deviation control depending on the disturbance is effected, excessive response immediately after the actuation is generated to largely tilt the steering roller 605, so that there is a possibility of occurrences of expansion and contraction of the intermediary transfer belt 606 and edge deformation of the intermediary transfer belt 606. Such excessive response can be prevented by the latter control in the above-described constitution (2).

By adding the following constitution (3) to the above-described constitutions (1) and (2), the functional effect by the constitution in which the tilting speed of the steering roller 605 is set at the low level, i.e., alleviation of degrees of the expansion and contraction of the intermediary transfer belt 606 and the edge deformation of the intermediary transfer belt 606 during the home position detection is added.

(3) The tilting speed of the steering roller when the origin position of the steering roller is detected is lower than the tilting speed of the steering roller when the lateral movement of the rotating belt member is controlled.

The steering cam HP search operation shown in S802 in FIG. 7 is performed in the rest state of the belt member. This is because when the belt member is conveyed before the phase of the steering cam 5 is determined, there is a possibility that the belt is abruptly laterally shifted depending on some phase state of the steering cam 5 to cause the lateral offset. However, when the tilting operation of the steering roller 605 in the belt member rest state is seen from the belt member side, the rolling slope becomes more abrupt than that in the ⅓-speed mode shown in FIG. 14, so that a very large stress is exerted on the belt member and the steering mechanism 201. For this reason, in the steering cam HP search operation in Embodiment 1, in S837 and S843, after the phase determination of the steering cam 5, an operation for returning the phase of the steering cam to that before the search. As a result, compared with the conventional constitution in which the cam phase is returned to the cam phase where the belt member is not shifted in both of the lateral directions, the belt conveyance can be started in the state in which the stress due to the HP search is reduced. When the belt member is driven, the steering cam 5 is gradually returned to and settled at a suitable position during the steering control.

<Comparison with Prior Art>

As described in JP-A 2002-2999, by regulating the tilting locus of the steering roller 605, it is possible to alleviate the stress exerted on the belt surface and the steering mechanism.

However, with respect to a resin belt of PI or the like and a metal belt such as a fixing belt, the degree of the expansion and contraction of the belt member is small and therefore the belt member is controlled, also during the steering operation, under a constraint condition such that the circumferential length of the belt member is constant. The steering operation essentially changes the stretching cross-sectional shape between the front side and the rear side and therefore and the constraint condition such that the belt member circumferential length is constant, the friction is always generated between some stretching roller and the belt member. Corresponding to this friction, the stress exerted on the belt stretching surface and the steering mechanism is generated.

This is also true for the case where the tilting locus regulation is seen in the full steering circumference of the belt even when the tilting locus regulation such that the stress exerted on the specific stretching surface is reduced as in JP-A 2002-2999. For example, when the tilting locus regulation is performed as shown in FIG. 8 of JP-A 2002-2999, a change in circumferential length of a surface 230 is small compared with that in FIG. 4 of JP-A 2002-2999 and therefore a degree of the friction between a roller 231 and the belt becomes small. However, on the other hand, the change in circumferential length generated by this regulation is absorbed by a tension roller 1C shown in FIG. 1 of JP-A 2002-2999 and therefore a degree of the friction between a roller 1*e* and a belt surface 2 becomes large.

Therefore, in the constitution described in JP-A 2002-2999, the problem in the low-speed mode which has been solved in Embodiments 1 and 2 cannot be solved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 212530/2011 filed Sep. 28, 2011, which is hereby incorporated by reference.

What is claimed is:

1. A belt driving apparatus comprising:

an endless belt member;

a belt driving portion for driving said belt member to move said belt member in an endless path at a variable traveling speed;

a steering roller, provided tiltably while stretching said belt member, for steering said belt member during traveling;

a steering driving portion for tilting said steering roller at a variable tilting speed; and a controller for setting the tilting speed, when said steering roller is tilted through a certain angle, so as to be higher when the traveling speed of said belt member is a first traveling speed than when the traveling speed of said belt member is a second traveling speed lower than the first traveling speed.

2. A belt driving apparatus according to claim 1, wherein said controller is capable of executing an operation in a first mode in which said steering roller is tilted to steer said belt member during traveling and an operation in a second mode, in advance of the first mode, in which said steering roller is tilted in a state in which said belt member is at rest, and wherein the tilting speed when said steering roller is tilted through the certain angle in the operation in the second mode is set so as to be lower than that in the operation in the first mode.

3. A belt driving apparatus according to claim 2, further comprising a detecting member for detecting a tilted state of said steering roller, wherein said controller tilts said steering roller in the operation in the second mode and returns, after the tilted state of said steering roller is detected by said detecting member, said steering roller to the tilted state before start of the tilting, and thereafter starts the operation in the first mode.

4. A belt driving apparatus according to claim 1, wherein said steering driving portion includes a pulse motor, and wherein said controller sets the tilting speed of said steering roller by setting a pulse interval of said pulse motor.

5. A belt driving apparatus according to claim 1, further comprising a detecting member for detecting a tilted state of said steering roller, wherein said controller is capable of executing an operation in a first mode in which said steering roller is tilted to steer said belt member during traveling and an operation in a second mode, in advance of the first mode, in which said steering roller is tilted in a state in which said belt member is at rest, and wherein said controller tilts said steering roller in the operation in the second mode and returns, after the tilted state of said steering roller is detected by said detecting member, said steering roller to the tilted state before start of the tilting, and thereafter starts the operation in the first mode.

6. An image forming apparatus comprising:

an endless intermediary transfer belt for carrying a toner image;

a toner image forming portion for forming the toner image on said intermediary transfer belt;

a transfer member for transferring the toner image from said intermediary transfer belt onto a recording material;

a belt driving portion for driving said intermediary transfer belt to move said intermediary transfer belt in an endless path at a variable traveling speed;

a steering roller, provided tiltably while stretching said intermediary transfer belt, for steering said intermediary transfer belt during traveling;

a steering driving portion for tilting said steering roller at a variable tilting speed; and a controller for setting the tilting speed, when said steering roller is tilted through a certain angle, so as to be higher when the traveling speed of said intermediary transfer belt is a first traveling speed than when the traveling speed of said intermediary transfer belt is a second traveling speed lower than the first traveling speed.

7. An image forming apparatus according to claim 6, further comprising a fixing member for fixing the toner image, transferred on the recording material, on the recording material by heating the toner image, wherein said controller sets the traveling speed of said intermediary transfer belt at the first traveling speed when the recording material is plain paper, and sets the traveling speed of said intermediary transfer belt at the second traveling speed when the recording material is thick paper.

8. An image forming apparatus according to claim 6, wherein said controller is capable of executing an operation in a first mode in which said steering roller is tilted to steer said intermediary transfer belt during traveling and an operation in a second mode, in advance of the first mode, in which said steering roller is tilted in a state in which said intermediary transfer belt is at rest, and wherein the tilting speed when said steering roller is tilted through the certain angle in the operation in the second mode is set so as to be lower than that in the operation in the first mode.

9. An image forming apparatus according to claim 6, further comprising a detecting member for detecting a tilted state of said steering roller, wherein said controller is capable of executing an operation in a first mode in which said steering roller is tilted to steer said intermediary transfer belt during traveling and an operation in a second mode, in advance of the first mode, in which said steering roller is tilted in a state in which said intermediary transfer belt is at rest, and wherein said controller tilts said steering roller in the operation in the second mode and returns, after the tilted state of said steering roller is detected by said detecting member, said steering roller to the tilted state before start of the tilting, and thereafter starts the operation in the first mode.

10. An image forming apparatus according to claim 8, wherein said controller forms, after the execution of the operation in the second mode is ended, the toner image on said intermediary transfer belt by said toner image forming portion during the execution of the operation in the first mode.

11. An image forming apparatus comprising:

an endless recording material conveyance belt for carrying and conveying a recording material;

a toner image forming portion for forming the toner image on the recording material carried by said recording material conveyance belt;

a belt driving portion for driving said recording material conveyance belt to move said recording material conveyance belt in an endless path at a variable traveling speed;

a steering roller, provided tiltably while stretching said recording material conveyance belt, for steering said recording material conveyance belt during traveling;

a steering driving portion for tilting said steering roller at a variable tilting speed; and a controller for setting the tilting speed, when said steering roller is tilted through a certain angle, so as to be higher when the traveling speed of said recording material conveyance belt is a first traveling speed than when the traveling speed of said recording material conveyance belt is a second traveling speed lower than the first traveling speed.

12. An image forming apparatus according to claim 11, further comprising a fixing member for fixing the toner image, formed on the recording material, on the recording material by heating the toner image, wherein said controller sets the traveling speed of said recording material conveyance belt at the first traveling speed when the recording material is plain paper, and sets the traveling speed of said recording material conveyance belt at the second traveling speed when the recording material is thick paper.

13. An image forming apparatus according to claim 11, wherein said controller is capable of executing an operation in a first mode in which said steering roller is tilted to steer said recording material conveyance belt during traveling and an operation in a second mode, in advance of the first mode, in which said steering roller is tilted in a state in which said recording material conveyance belt is at rest, and wherein the tilting speed when said steering roller is tilted through the certain angle in the operation in the second mode is set so as to be lower than that in the operation in the first mode.

14. An image forming apparatus according to claim 11, further comprising a detecting member for detecting a tilted state of said steering roller, wherein said controller is capable of executing an operation in a first mode in which said steering roller is tilted to steer said recording material conveyance belt during traveling and an operation in a second mode, in advance of the first mode, in which said steering roller is tilted in a state in which said recording material conveyance belt is at rest, and wherein said controller tilts said steering roller in the operation in the second mode and returns, after the tilted state of said steering roller is detected by said detecting member, said steering roller to the tilted state before start of the tilting, and thereafter starts the operation in the first mode.

15. An image forming apparatus according to claim 11, wherein said controller forms, after the execution of the operation in the second mode is ended, the toner image on the recording material carried by said recording material conveyance belt during the execution of the operation in the first mode.

* * * * *